US010167612B2

(12) United States Patent
Kohzu et al.

(10) Patent No.: US 10,167,612 B2
(45) Date of Patent: Jan. 1, 2019

(54) COUNTERWEIGHT DEVICE FOR ARRANGING ACCUMULATORS INSIDE THE COUNTERWEIGHT OF A WORKING MACHINE

(71) Applicant: Caterpillar SARL, Geneva (CH)

(72) Inventors: Yoshihisa Kohzu, Tokyo (JP); Akito Nakai, Tokyo (JP)

(73) Assignee: Caterpillar SARL, Geneva (CH)

( * ) Notice: Subject to any disclaimer, the term of this patent is extended or adjusted under 35 U.S.C. 154(b) by 147 days.

(21) Appl. No.: 15/021,526

(22) PCT Filed: Sep. 12, 2014

(86) PCT No.: PCT/EP2014/069511
§ 371 (c)(1),
(2) Date: Mar. 11, 2016

(87) PCT Pub. No.: WO2015/039967
PCT Pub. Date: Mar. 26, 2015

(65) Prior Publication Data

US 2016/0222632 A1 Aug. 4, 2016

(30) Foreign Application Priority Data

Sep. 18, 2013 (JP) ..... 2013-192921

(51) Int. Cl.
*E02F 9/18* (2006.01)
*E02F 9/22* (2006.01)

(52) U.S. Cl.
CPC ..... *E02F 9/2217* (2013.01); *E02F 9/18* (2013.01); *E02F 9/2264* (2013.01)

(58) Field of Classification Search
CPC .... B60K 1/04; B60K 6/12; B60K 2001/0416; B60K 2006/123; B60K 2006/126;
(Continued)

(56) References Cited

U.S. PATENT DOCUMENTS 3,217,825 A 11/1965 Hauxwell et al.
3,367,441 A 2/1968 Schuster et al.
(Continued)

FOREIGN PATENT DOCUMENTS

EP 1762537 A1 3/2007
GB 1111640 A 5/1968
(Continued)

OTHER PUBLICATIONS

European Patent Office, International Search Report in International Patent Application No. PCT/EP2014/069511, dated Oct. 28, 2014, 3 pp.

*Primary Examiner* — Saul Rodriguez
*Assistant Examiner* — Brendan P Tighe

(57) ABSTRACT

Counterweight device in which an accumulator is disposed inside a counterweight, the work machine connecting the accumulator to piping at the machine body side and capable of moving a machine body or work device even though the counterweight is not attached to the body. A counterweight is fixed to a mount base at the rear end part of a swinging frame, an accumulator installed inside the counterweight by means of a temporary placing support structure. The temporary placing support structure can be temporarily placed on and attached to the end plate at the swinging frame side before attaching the counterweight.

8 Claims, 4 Drawing Sheets

(58) Field of Classification Search
CPC ..... B60W 2300/17; B60Y 2200/412; B62D 49/085; B66F 9/07554; B66F 9/24; B66F 9/07518; E02F 3/325; E02F 9/0858; E02F 9/0866; E02F 9/0875; E02F 9/0883; E02F 9/18; E02F 9/2217
USPC ..... 180/165, 312; 220/562; 280/834, 835
See application file for complete search history.

(56) References Cited

U.S. PATENT DOCUMENTS

| | | | | |
|---|---|---|---|---|
| 3,497,090 | A | 2/1970 | Daniels | |
| 4,149,733 | A | 4/1979 | Grooss | |
| 4,397,365 | A | 8/1983 | Harbe et al. | |
| 4,761,954 | A | 8/1988 | Rosman | |
| 6,170,180 | B1 | 1/2001 | Schaeff | |
| 6,199,307 | B1 | 3/2001 | Kagoshima et al. | |
| 6,244,369 | B1 * | 6/2001 | Yunoue | B60J 5/0487 180/89.12 |
| 6,901,729 | B1 | 6/2005 | Otto et al. | |
| 7,388,301 | B2 | 6/2008 | Komiyama et al. | |
| 7,810,597 | B2 | 10/2010 | Imashige | |
| 7,849,951 | B2 | 12/2010 | Borchers et al. | |
| 8,100,210 | B2 | 1/2012 | Takeuchi et al. | |
| 8,381,856 | B2 | 2/2013 | Shimomura et al. | |
| 8,540,042 | B2 | 9/2013 | Atarashi et al. | |
| 8,616,322 | B2 | 12/2013 | Shimomura et al. | |
| 8,631,890 | B2 | 1/2014 | Noguchi et al. | |
| 8,662,969 | B2 | 3/2014 | Shimomura et al. | |
| 2001/0007292 | A1 * | 7/2001 | Yabf | E02F 9/0866 180/68.1 |
| 2007/0062894 | A1 * | 3/2007 | Kubusch | B60K 15/07 211/85.18 |
| 2007/0072063 | A1 | 3/2007 | Imashige | |
| 2013/0141889 | A1 | 6/2013 | Tsuchiya et al. | |
| 2013/0299255 | A1 | 11/2013 | Matsumura et al. | |
| 2013/0313030 | A1 | 11/2013 | Matsumura et al. | |
| 2014/0000973 | A1 | 1/2014 | O'Donnell et al. | |

FOREIGN PATENT DOCUMENTS

| | | | | |
|---|---|---|---|---|
| JP | 2003-213728 | A | | 7/2003 |
| JP | 2004-116676 | A | | 4/2004 |
| JP | 2008-013990 | A | | 1/2008 |
| JP | 2008013990 | A | * | 1/2008 |
| JP | 2008-045365 | A | | 2/2008 |

* cited by examiner

COUNTERWEIGHT DEVICE FOR ARRANGING ACCUMULATORS INSIDE THE COUNTERWEIGHT OF A WORKING MACHINE

CROSS-REFERENCE TO RELATED APPLICATIONS

This application is a national phase application of International Patent Application No. PCT/EP2014/069511, filed Sep. 12, 2014, which claims priority to Japanese Patent Application No. 2013-192921, filed Sep. 18, 2013, both of which are incorporated by reference herein in their entireties for all purposes.

TECHNICAL FIELD

The present invention relates to a counterweight device in a working machine that has accumulators arranged inside a counterweight.

BACKGROUND ART

In recent years, there have been developed hydraulic shovels that accumulate in accumulators positional energy of a working unit and that enable the accumulated positional energy to be reused for a lift operation and the like of a working machine. In this case, in order to accumulate sufficient positional energy, a plurality of accumulators having large capacities need to be installed. Further, an accumulator arrangement space needs to be secured on a hydraulic shovel slewing frame, and a structure (the slewing frame) design that can bear the weight of the accumulators is demanded.

On the other hand, because of the structure of the hydraulic shovel, heavy goods are desired to be arranged at the back of the vehicle. Therefore, at present, there is employed a design for providing the accumulator arrangement space in front of a rear-end part counterweight on the slewing frame, and reinforcing the periphery of the accumulator fitting portion based on the weight of the accumulators.

As techniques for solving the above problem, techniques for using the internal space of the counterweight for the arrangement of the accumulators are disclosed (see Patent Document 1 and Patent Document 2, for example).

Patent Document 1 indicates that, in a hydraulic shovel that includes a counterweight detachable device, accumulators are arranged inside a counterweight, and a check valve is provided on the accumulator installation base at the counterweight side. With this arrangement, in case of separating the counterweight from a machine body at a transportation time and the like, the counterweight can be separated in a state where the accumulators are left in the counterweight.

Patent Document 2 indicates that as an example of a working machine that can satisfactorily keep stability without increasing the weight of the counterweight, even when the accumulators are in a state of being fitted, the accumulators are arranged on an upper surface of or inside the counterweight.

As advantages of these techniques, when the accumulators play the role of the counterweight, the weight of the counterweight itself can be reduced. That is, the quantity of cement or the like that is filled in the counterweight can be reduced. Further, because the total weight of the counterweight and the accumulator does not increase, it is not necessary to arrange specific reinforcement at the periphery of the slewing frame accumulator fitting portion. Also, the techniques become advantageous in the aspect of layout on the slewing frame.

Patent Document 1: Japanese Patent Application Laid-open No. 2008-45365

Patent Document 2: Japanese Patent Application Laid-open No. 2004-116676

DISCLOSURE OF THE INVENTION

On the other hand, in the procedure of assembling and maintenance of the hydraulic shovel, the counterweight is a portion that is fitted onto the slewing frame after completing the assembling of a hydraulic piping to the slewing frame. It is required that the hydraulic shovel can be operated even when the counterweight is not yet installed. That is, there arise an operation of traveling to a counterweight installation place at the assembling time, and an operation of traveling when transporting the hydraulic shovel to a work field in the state where the counterweight is taken out.

In this case, it is necessary that the accumulators as a part of configuration portions of the hydraulic circuits have been fitted onto the slewing frame and also the piping work has been completed. However, when the accumulators have been fitted inside the counterweight like the working machine in Patent Document 1, or when the accumulators have been fitted to the upper surface of the counterweight or inside the counterweight like the working machine in Patent Document 2, it is difficult to make it possible to operate the machine body or the working device by connecting the accumulators to the piping at the machine body side in a counterweight not-yet-installed state, that is, prior to the installation of the counterweight onto the slewing frame or the machine body.

The present invention has been made in view of the above points. An object of the invention is to provide a counterweight device in a working machine that has accumulators arranged inside a counterweight, the working machine capable of moving a machine body by connecting the accumulators to a piping at a machine body side, even in a state where the counterweight is not yet installed on the machine body.

The invention described in claim 1 is a counterweight device in a working machine. The working machine includes a machine body which is driven by fluid pressure actuators, a working device which is mounted at one end side of the machine body and which can be operated by the fluid pressure actuators, and a counterweight which is mounted at the other end side of the machine body. The counterweight device includes a temporary placement support structure in which inside the counterweight, accumulators can be arranged which pressure-accumulate and pressure-discharge an operation fluid which is pressure-supplied to the fluid pressure actuators which operate the machine body or the working device, this temporary placement support structure being able to be temporarily fitted to a machine body side.

The invention described in claim 2 is a counterweight device in a working machine. The temporary placement support structure described in claim 1 includes an accumulator support frame unit that can be arranged inside the counterweight in a state where the accumulator support frame unit accommodates the accumulators, an end plate that is provided at a height at which the end plate can correspond to the accumulator support frame unit on a machine body side adjacent to the counterweight, and a plurality of temporary joint units that temporarily joint the accumulator support frame unit to the end plate.

The invention described in claim 3 is a counterweight device in a working machine. The temporary joint units described in claim 2 include a plurality of temporary placement support hooks that are integrally fitted to the accumulator support frame unit, and a plurality of temporary placement support holes that are formed on the end plate and are capable of being engaged with the temporary placement support hooks.

The invention described in claim 4 is a counterweight device in a working machine. The temporary placement support structure described in claim 1 includes an accumulator support frame unit that can be arranged inside the counterweight in a state where the accumulator support frame unit accommodates the accumulators, a temporary placement jig that extends the end plate to a height at which the end plate can correspond to the accumulator support frame unit, an upper end of the end plate being positioned at a low portion of the accumulator support frame unit on a machine body side adjacent to the counterweight, and a plurality of temporary joint units that temporarily joint the accumulator support frame unit to the temporary placement jig.

According to the invention described in claim 1, in the working machine in which the accumulators are arranged inside the counterweight, the accumulators can be set at the machine body side in the temporary placement support structure even in a counterweight not-yet-installed state, that is, prior to the installation of the counterweight onto the machine body. Therefore, the machine body can be moved by connecting the piping at the machine body side to accumulators. Further, when detachment of the counterweight is necessary due to the maintenance or the like of the machine body, only the counterweight can be detached without detaching the piping, in the state where the piping at the machine body side is connected to the accumulators in the temporary placement support structure. Further, by arranging the accumulators inside the counterweight, the counterweight filling quantity corresponding to the accumulator weight can be reduced. Because the total weight of the counterweight remains unchanged, reinforcement of the peripheral structure of the accumulator-fitted portion at the machine body side becomes unnecessary. In addition, because the accumulators are arranged inside the counterweight, layout of the machine body side becomes advantageous.

According to the invention described in claim 2, the temporary placement support structure temporarily joint the accumulator support frame unit that can be arranged inside the counterweight, in the state where the accumulator support frame unit accommodates the accumulators, to the end plate at the machine body side by the plurality of temporary joint units. Therefore, the accumulators can be easily temporarily placed in the temporary placement support structure, during a period from after assembling the piping to the accumulators until the installment of the counterweight, and the machine body or the working device can be moved.

According to the invention described in claim 3, the accumulator support frame unit can be easily temporarily jointed to the end plate by the plurality of temporary placement support hooks that can be engaged with the plurality of temporary placement support holes which are formed on the end plate.

According to the invention described in claim 4, the temporary placement support structure includes the temporary placement jig that extends the end plate to a height at which the end plate can match the accumulator support frame unit, the upper end of the end plate being positioned at the low portion of the accumulator support frame unit at the machine body side adjacent to the counterweight. The temporary placement support structure temporarily joint the accumulator support frame unit to the temporary placement jig, by the plurality of temporary joint units. Therefore, the end plate at the machine body side does not need to be replaced, and the temporary placement jig of the same shape can be used for a plurality of machine bodies. As a result, the temporary placement support structure is advantageous in the cost aspect.

BEST MODE FOR CARRYING OUT THE INVENTION

Hereinafter, a first embodiment and a second embodiment of the present invention will be described in detail with reference to FIGS. 1 to 7 and FIGS. 8 and 9, respectively.

First, the first embodiment will be described with reference to FIGS. 1 to 7.

Figure 6:
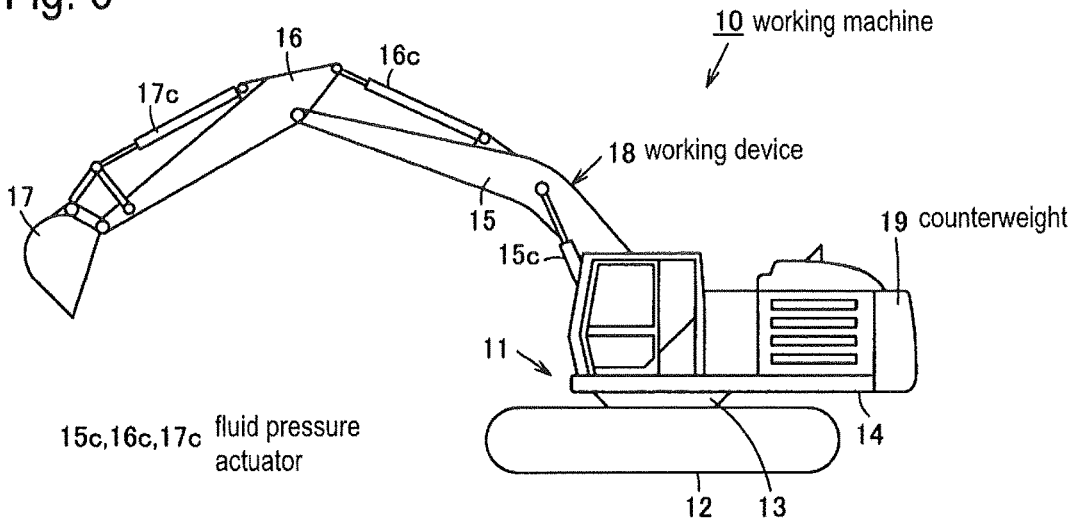
FIG. 6 is a side view of a working machine that includes the device.

As shown in FIG. 6, a hydraulic shovel 10 as a working machine includes as a machine body 11, a crawler type lower traveling body 12 that is driven to travel by a traveling motor (not shown), and an upper slewing body 14 that is driven to slew by a slewing motor (not shown) via a slewing bearing unit 13 on the lower traveling body 12. At the front side of the upper slewing body 14, there is mounted a working device 18 that includes a boom 15 which is turned by a boom cylinder 15*c*, a stick 16 which is turned by a stick cylinder 16*c*, and a bucket 17 which is turned by a bucket cylinder 17*c*. At the rear side of the upper slewing body 14, there is mounted a counterweight 19 for keeping weight balance with the working device 18 and the like.

The traveling motor, the slewing motor, the boom cylinder 15*c*, the stick cylinder 16*c*, and the bucket cylinder 17*c* are hydraulic actuators as fluid pressure actuators that are driven by hydraulic pressures as hydraulic fluid pressures discharged from a pump that is driven by an engine (not shown) which is mounted on the upper slewing body 14. In a hydraulic piping of a hydraulic fluid that is pressure-supplied to the hydraulic actuators by the pump from a tank mounted on the upper slewing body 14, there are provided accumulators described below that absorb and pressure-accumulate surplus energy and also that assist the engine by pressure-discharging shortage energy.

Figure 7:
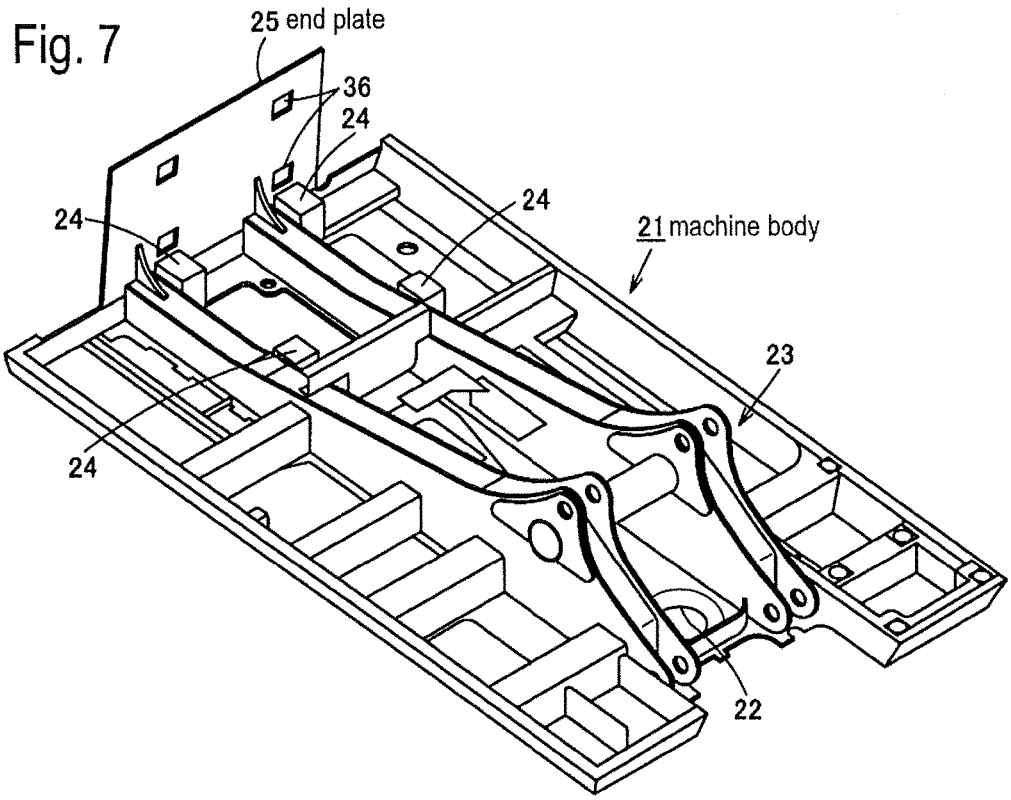
FIG. 7 is a perspective view of a machine body of the working machine.

The upper slewing body 14 includes a slewing frame 21 as a machine body shown in FIG. 7. In the slewing frame 21, there is provided a center frame 23 backward from a slewing support portion 22 that is slewably supported by the slewing bearing unit 13. At the rear part of the center frame 23, an end plate 25 is integrally provided with engine mounting parts 24 for supporting the engine, by welding or the like. The end plate 25 is formed to extend above the vehicle, as compared with a conventional type end plate to which the counterweight 19 is directly fitted.

The slewing frame 21 can be moved by the traveling motor and can be also slewed by the slewing motor, and is driven by these hydraulic actuators.

Figure 1:
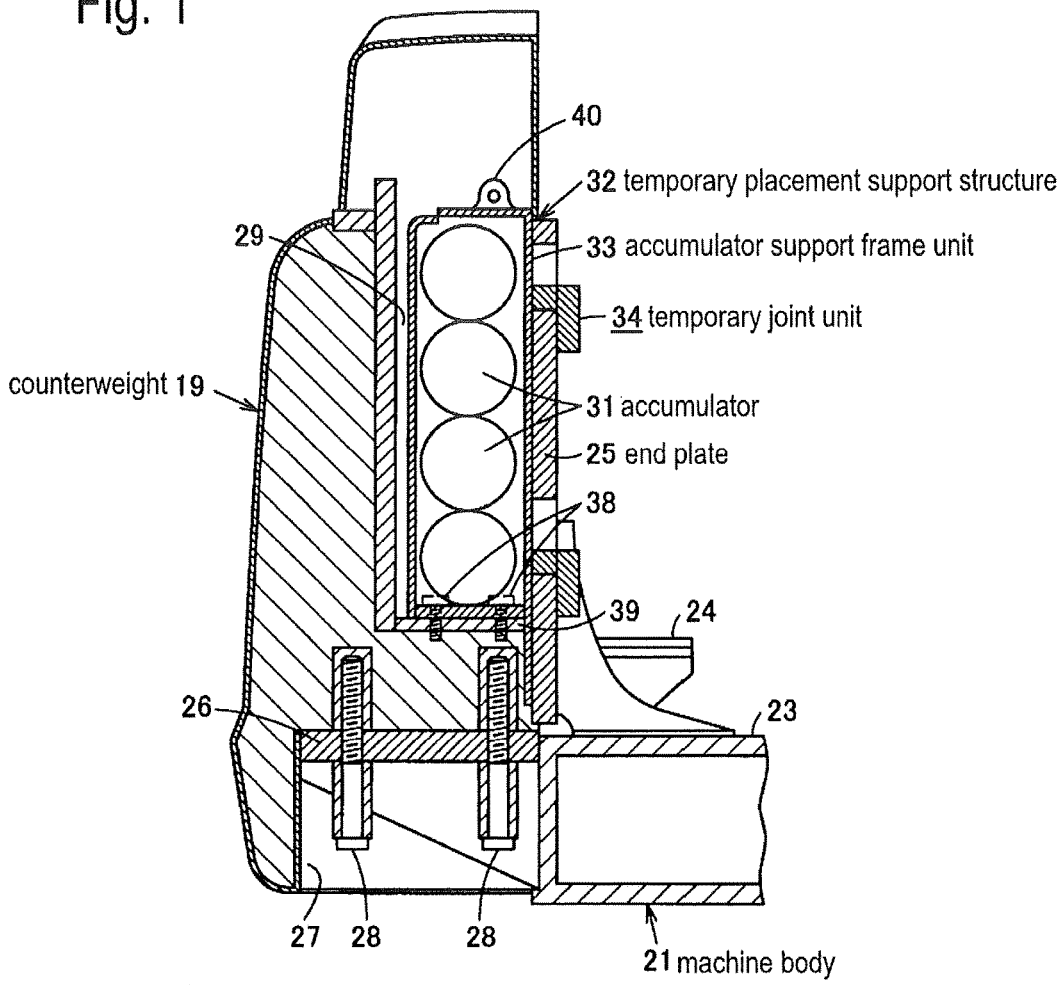
FIG. 1 is a vertical sectional view of a counterweight device in a working machine according to a first embodiment of the present invention.
Figure 2:
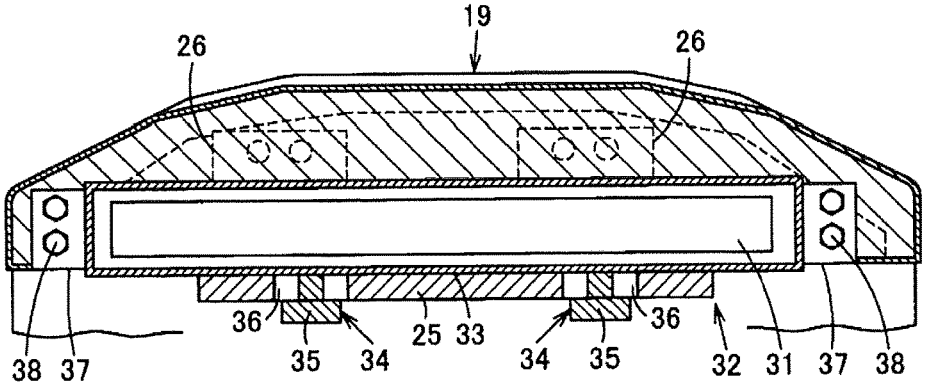
FIG. 2 is a lateral sectional view of the device.
Figure 3:
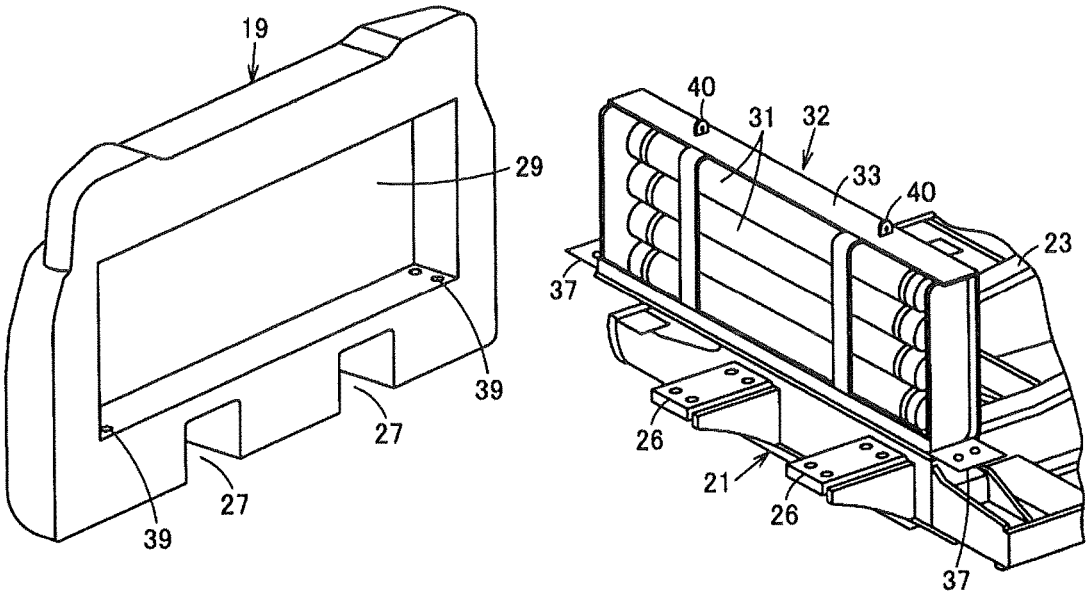
FIG. 3 is an exploded perspective view of the device.

As shown in FIGS. 1 to 3, at the rear part of the slewing frame 21, a pair of mounting bases 26 fixed by welding or the like are stretched. At the lower surface side of the counterweight 19, recessed grooves 27 that are to be fitted to the mounting bases 26 are provided. The recessed grooves 27 are fixed to the mounting bases 26 with counterweight fitting bolts 28 that are inserted from the lower side of the mounting bases 26, in a state where the recessed grooves 27 are mounted on the mounting bases 26 as shown in FIG. 1. As shown in FIG. 3, on the surface of the counterweight 19 that becomes opposite to the end plate 25, an accumulator support accommodation recess portion 29 is open.

FIGS. 1 and 2 show a temporary placement support structure 32 in which inside the counterweight 19, accumulators 31 can be arranged which pressure-accumulate and pressure-discharge an operation fluid which is pressure-supplied to the fluid pressure actuators (the traveling motor, the slewing motor, the boom cylinder 15*c*, the stick cylinder 16*c*, and the bucket cylinder 17*c*) which operate the slewing frame 21 or the working device 18, and that can be temporarily fitted to a slewing frame 21 side.

The temporary placement support structure 32 includes an accumulator support frame unit 33 that can be arranged inside the counterweight 19 in the state where the accumulator support frame unit accommodates the accumulators 31, the end plate 25 that is provided in the height at which the end plate 25 can correspond to the accumulator support frame unit 33 at the slewing frame 21 side adjacent to the counterweight 19, and a plurality of temporary joint units 34 that temporarily joint the accumulator support frame unit 33 to the end plate 25.

Figure 4:
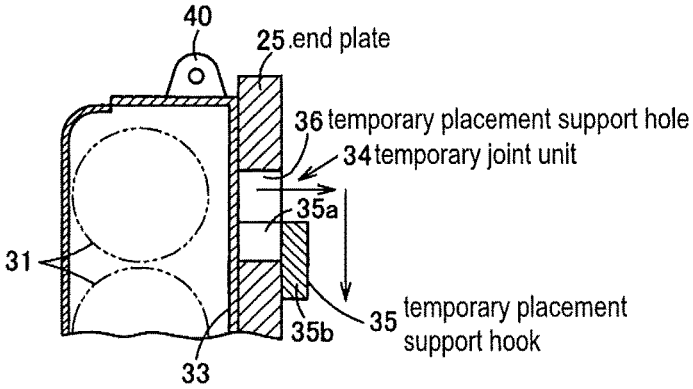
FIG. 4 is a side sectional view of an engagement structure of a temporary placement support hook with a temporary placement support hole of the device.
Figure 5:
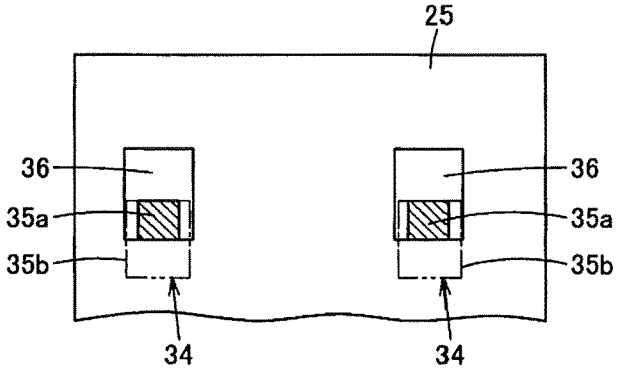
FIG. 5 is a front sectional view of the engagement structure.

The temporary joint units 34 include a plurality of temporary placement support hooks 35 that are welded to the accumulator support frame unit 33, and a plurality of temporary placement support holes 36 that are formed on the end plate 25 and are capable of being engaged with the temporary placement support hooks 35, as shown in FIGS. 4 and 5.

Each temporary placement support hook 35 is an integration of an engagement plate 35*b* having a size in which the engagement plate 35*b* can pass through the temporary placement support hole 36 via a small neck portion 35*a* having a smaller width than that of the temporary placement support hole 36.

As shown in FIGS. 2 and 3, the accumulator support frame unit 33 is provided with fixing units for fastening the frame unit 33 inside the counterweight 19. The fixing units are fixing plates 37 that are fitted respectively to lower parts of plates at left and right sides of the accumulator support frame unit 33, the fixing plates 37 for fixing the frame unit 33 to the inside of the accumulator support accommodation recess portion 29 of the counterweight 19. The accumulator support frame unit 33 is fitted to the inside of the accumulator support accommodation recess portion 29 of the counterweight 19. Fastening bolts 38 are pierced through bolt insertion holes of the fixing plates 37 of the accumulator support frame unit 33, and are screwed into screw holes of fixing portions 39 formed on a bottom part of the accumulator support accommodation recess portion 29. As a result, the accumulator support frame unit 33 is fastened and fixed.

At upper plate parts of the accumulator support frame unit 33, a pair of wire notch portions 40 are provided, so that the accumulator support frame unit 33 can be lifted by a crane.

As described above, the accumulator support frame unit 33 of the temporary placement support structure 32 is used to fix the accumulators 31. The accumulator support frame unit 33 is fixed to the inside of the counterweight 19 with the fastening bolts 38. Also, the end plate 25 of the temporary placement support structure 32 that makes it possible to temporarily place the accumulator support frame unit 33 at the slewing frame 21 side is provided.

Next, work effects of the first embodiment shown in FIGS. 1 to 7 will be described.

At the vehicle assembling time, first, the plurality of accumulators 31 are installed on the accumulator support frame unit 33. The accumulator support frame unit 33 is temporarily set in the end plate 25 for temporary placement support at the slewing frame side.

At this time, as shown in FIG. 4, the temporary placement support hooks 35 of the accumulator support frame unit 33 are inserted horizontally into the temporary placement support holes 36 of the end plate 25, and are thereafter lowered to engage the temporary placement support hooks 35 with lower edge parts of the temporary placement support holes 36.

Then, the hydraulic piping at the slewing frame 21 side is connected to the plurality of accumulators 31 to make it possible to operate the hydraulic shovel. For example, even when the counterweight 19 is not present, the machine body 11 mounted with the accumulators 31 is in a state of being able to travel by itself by driving the traveling motor. Therefore, the machine body 11 can ride and get out of a transportation vehicle such as a trailer.

In fixing the counterweight 19 to the slewing frame 21, the recessed grooves 27 of the counterweight 19 are fitted to the mounting bases 26, and are fixed with the counterweight fitting bolts 28. Further, with the fastening bolts 38, the pair of fixing plates 37 of the accumulator support frame unit 33 are fixed to the screw holes of the fixing portions 39 of the counterweight 19.

At this time, as shown in FIG. 5, a space for play is present between left and right parts of the neck portion 35*a* of the temporary placement support hook 35 and the temporary placement support hole 36. Therefore, positional adjustment when fixing the accumulator support frame unit 33 with the fastening bolts 38 becomes easy.

As described above, in the hydraulic shovel 10 having the accumulators 31 arranged inside the counterweight 19, there is provided the structure that can have the accumulator support frame unit 33 temporarily placed at the slewing frame 21 side, in addition to the fitting portion inside the counterweight. With this arrangement, the following effects can be obtained.

The accumulators 31 can be set at the slewing frame 21 side in the temporary placement support structure 32, even in the counterweight not-yet-installed state, that is, prior to the installation of the counterweight onto the slewing frame 21. Therefore, the slewing frame 21 can be traveled or slewed, by completing the connection between the hydraulic piping at the slewing frame 21 side and the accumulators 31.

Also when detachment of the counterweight 19 is necessary for the maintenance and the like of the machine body 11, detachment of only the counterweight 19 becomes possible without detaching the hydraulic piping, in the state where the hydraulic piping at the slewing frame 21 side is connected to the accumulators 31 by using the temporary placement support structure 32.

Further, by arranging the accumulators 31 inside the counterweight 19, the counterweight filling quantity corresponding to the accumulator weight can be reduced. Because the total weight of the counterweight remains unchanged, reinforcement of the peripheral structure of the accumulator-fitted portion at the slewing frame 21 side becomes unnecessary. In addition, because the accumulators 31 are arranged inside the counterweight 19, layout of the slewing frame 21 side becomes advantageous.

In the temporary placement support structure 32 shown in FIGS. 1 and 2, the accumulator support frame unit 33 that can be arranged inside the counterweight 19 in the state where the accumulator support frame unit 33 accommodates the accumulator 31 can be temporarily jointed to the end plate 25 at the slewing frame 21 side with the plurality of temporary joint units 34. Therefore, the accumulators 31 can be easily temporarily placed in the temporary placement support structure 32, during a period from after assembling the piping to the accumulators 31 until the installment of the counterweight, and the slewing frame 21 or the working device 18 can be moved.

As shown in FIGS. 4 and 5, the accumulator support frame unit 33 can be easily temporarily jointed to the end plate 25, with the plurality of temporary placement support hooks 35 in the plurality of temporary placement support holes 36 that are formed on the end plate 25. Therefore, the assembling of the accumulator support frame unit 33 can be simplified.

Next, a second embodiment will be described with reference to FIGS. 8 and 9. Portions similar to those in the first embodiment shown in FIGS. 1 to 7 are attached with identical reference numerals and their descriptions will be omitted.

In the second embodiment, a plate-shaped temporary placement jig 41 is prepared as a temporary placement exclusive jig separately from an end plate 25A of the slewing frame 21, and is fitted to the end plate 25A at the assembling time.

Figure 8:
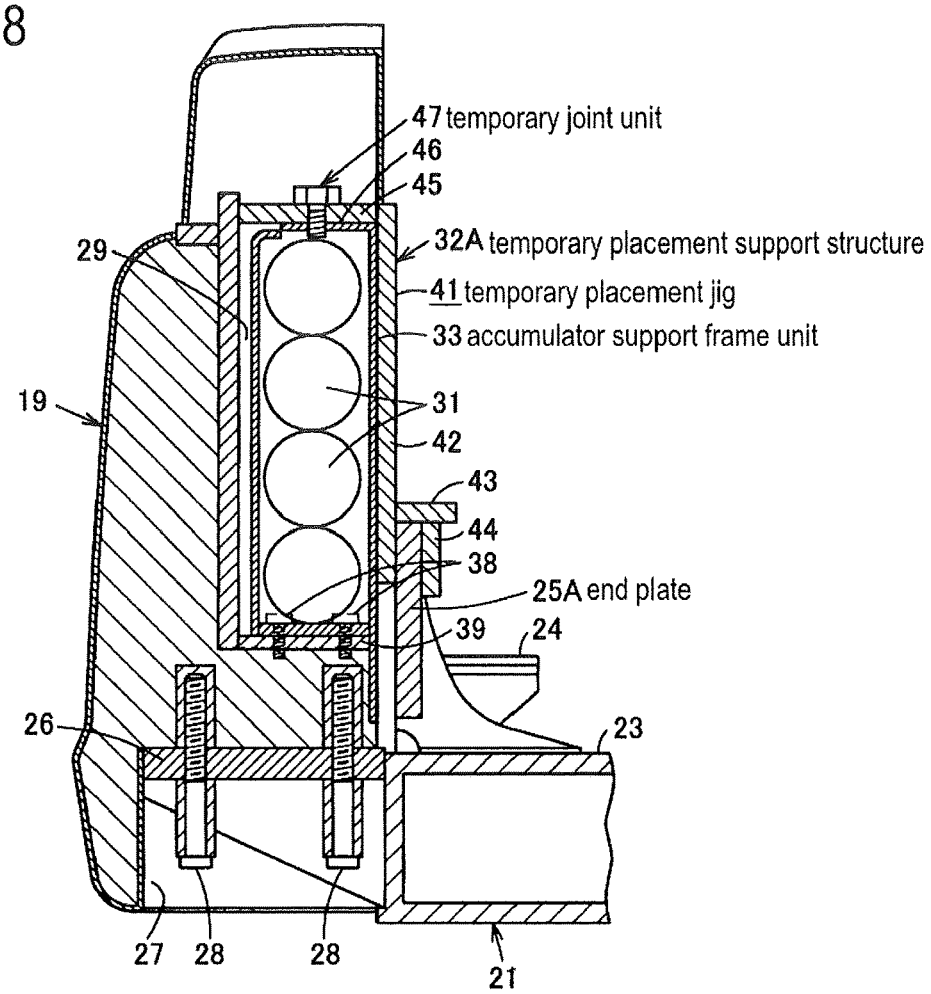
FIG. 8 is a sectional view of a counterweight device in a working machine according to a second embodiment of the present invention.

That is, a temporary placement support structure 32A shown in FIG. 8 includes the temporary placement jig 41 that extends the end plate 25A to a height at which the end plate 25A can match the accumulator support frame unit 33, an upper end of the end plate 25A being positioned at a low portion of the accumulator support frame unit 33 at the slewing frame 21 side adjacent to the counterweight 19.

The temporary placement jig 41 has a plate part 44 which is fitted to an upper edge part of the end plate 25A, welded to the temporary placement jig 41, via a plate part 43 which is welded to a slightly upper side than a lower end of a plate-shaped jig body 42. The temporary placement jig 41 has also a ceiling plate part 45 which is positioned on the accumulator support frame unit 33 from an upper end of the jig body 42, welded to the temporary placement jig 41.

Further, as a plurality of temporary joint units, temporary fastening bolts 47 are respectively screwed with a pair of screw holes that are provided on a ceiling plate part 46 of the accumulator support frame unit 33, via a pair of bolt insertion holes formed on the ceiling plate part 45 of the temporary placement jig 41. The accumulator support frame unit 33 is temporarily jointed to the temporary placement jig 41.

Figure 9:
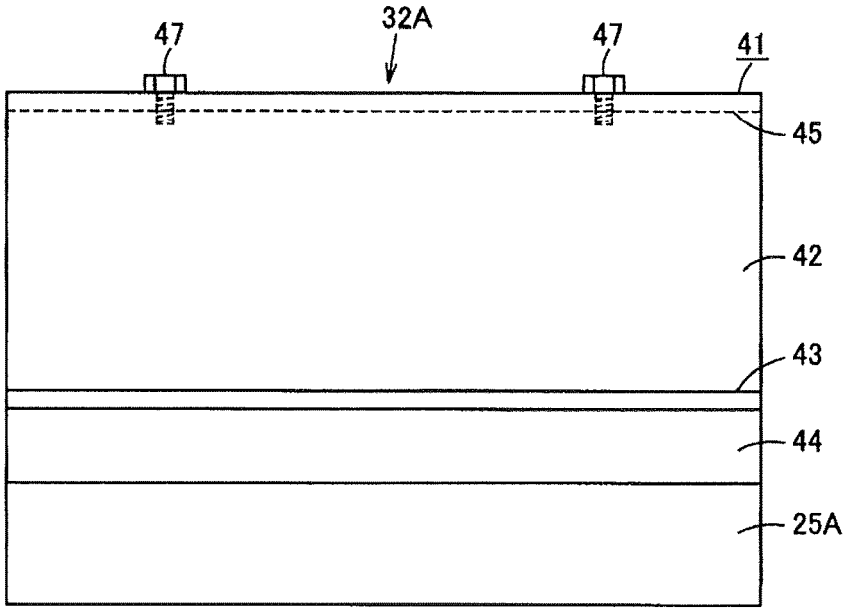
FIG. 9 is a front view of a temporary placement jig of the device.

The temporary placement support structure 32A shown in FIGS. 8 and 9 includes the temporary placement jig 41 that extends the end plate 25A to the height capable of matching the accumulator support frame unit 33, the upper end of the end plate 25A being positioned at the low portion of the accumulator support frame unit 33 at the slewing frame 21 side adjacent to the counterweight 19. The accumulator support frame unit 33 is temporarily jointed to the temporary placement jig 41 with the plurality of temporary fastening bolts 47. Therefore, the end plate 25A at the slewing frame 21 side can be directly used, and does not require improvement. Because the same temporary placement jig 41 can be used for the plurality of slewing frames 21, cost can be reduced.

INDUSTRIAL APPLICABILITY

The present invention has industrial applicability to business operators who are engaged in manufacturing and marketing of working machines.

EXPLANATION OF REFERENCE NUMERALS

10 hydraulic shovel as working machine
15*c*, 16*c*, and 17*c* hydraulic actuator as hydraulic pressure actuator
18 working device
19 counterweight
21 slewing frame as machine body
25 end plate
25A end plate
31 accumulator
32 temporary placement support structure
32A temporary placement support structure
33 accumulator support frame unit
34 temporary joint unit
35 temporary placement support hook
36 temporary placement support hole
41 temporary placement jig
47 temporary fastening bolt as temporary joint unit

The invention claimed is:

1. A counterweight device in a working machine, the working machine including:

a plurality of fluid pressure actuators;

a machine body driven by a first actuator of the plurality of fluid pressure actuators;

a working device mounted at a first end side of the machine body and operatively coupled to a second actuator of the plurality of fluid pressure actuators; and a counterweight disposed on a second end side of the machine body, the second end side of the machine body being disposed opposite the first end side of the machine body, the counterweight device comprising:

a temporary placement support structure disposed inside a recess portion of the counterweight; and a plurality of accumulators disposed within the temporary placement support structure and fluidly coupled to the plurality of fluid pressure actuators for transfer of fluid power therebetween, the temporary placement support structure and the plurality of accumulators being mounted to the machine body independent of whether the counterweight is mounted to the machine body.

2. The counterweight device in the working machine according to claim 1, wherein the temporary placement support structure comprises:

an accumulator support frame unit;

an end plate disposed at a height which corresponds to the accumulator support frame unit on a machine body side adjacent to the counterweight; and a plurality of temporary joint units that temporarily join the accumulator support frame unit to the end plate.

3. The counterweight device in the working machine according to claim 2, wherein the plurality of temporary joint units comprises:

a plurality of temporary placement support hooks that are integrally fitted to the accumulator support frame unit; and a plurality of temporary placement support holes that are formed on the end plate and that are engaged with the temporary placement support hooks to support the temporary placement support structure on the machine body.

4. The counterweight device in the working machine according to claim 1, wherein the temporary placement support structure further comprises an accumulator support frame unit;

a temporary placement jig that extends the end plate of the machine body to a height which corresponds to the accumulator support frame unit, an upper end of the end plate being positioned at a low portion of the accumulator support frame unit on a machine body side adjacent to the counterweight; and a plurality of temporary joint units that temporarily join the accumulator support frame unit to the temporary placement jig.

5. A machine comprising:

a plurality of fluid pressure actuators;

a machine body driven by a first actuator of the plurality of fluid pressure actuators;

a working device mounted at a first end side of the machine body, the working device being operatively coupled to a second actuator of the plurality of fluid pressure actuators;

a counterweight disposed on a second end side of the machine body, the second end side of the machine body being disposed opposite the first end side of the machine body;

a temporary placement support structure disposed inside a recess portion of the counterweight; and a plurality of accumulators disposed within the temporary placement support structure and fluidly coupled to the plurality of fluid pressure actuators for transfer of fluid power therebetween, the temporary placement support structure and the plurality of accumulators being mounted to the machine body independent of whether the counterweight is mounted to the machine body.

6. The machine according to claim 5, wherein the temporary placement support structure includes:

an accumulator support frame unit;

an end plate disposed at a height which corresponds to the accumulator support frame unit on a machine body side adjacent to the counterweight; and a plurality of temporary joint units that temporarily join the accumulator support frame unit to the end plate.

7. The machine according to claim 6, wherein the plurality of temporary joint units includes:

a plurality of temporary placement support hooks that are integrally fitted to the accumulator support frame unit; and a plurality of temporary placement support holes that are formed on the end plate and that are engaged with the temporary placement support hooks to support the temporary placement support structure on the machine body.

8. The machine according to claim 5, wherein the temporary placement support structure includes:

an accumulator support frame unit;

a temporary placement jig that extends an end plate of the machine body to a height which corresponds to the accumulator support frame unit, an upper end of the end plate being positioned at a low portion of the accumulator support frame unit on a machine body side adjacent to the counterweight; and a plurality of temporary joint units that temporarily join the accumulator support frame unit to the temporary placement jig.

* * * * *